US011307512B2

(12) United States Patent
Tanaka et al.

(10) Patent No.: US 11,307,512 B2
(45) Date of Patent: Apr. 19, 2022

(54) IMAGE FORMING APPARATUS DETERMINING TONER REPLACEMENT TIMING

(71) Applicant: KYOCERA Document Solutions Inc., Osaka (JP)

(72) Inventors: Kazunori Tanaka, Osaka (JP); Kanako Morimoto, Osaka (JP); Tamotsu Shimizu, Osaka (JP); Kenichi Tamaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/165,370

(22) Filed: Feb. 2, 2021

(65) Prior Publication Data

US 2021/0240102 A1 Aug. 5, 2021

(30) Foreign Application Priority Data

Feb. 3, 2020 (JP) ..... JP2020-016348

(51) Int. Cl.
*G03G 15/08* (2006.01)
*G03G 15/16* (2006.01)

(52) U.S. Cl.
CPC ..... *G03G 15/0851* (2013.01); *G03G 15/169* (2013.01)

(58) Field of Classification Search
CPC ..... G03G 15/0851; G03G 15/169; G03G 15/5037; G03G 15/5041; G03G 15/55
See application file for complete search history.

(56) References Cited

U.S. PATENT DOCUMENTS

2004/0253528 A1* 12/2004 Yamashita ..... G03G 9/1131 430/111.35
2016/0274488 A1* 9/2016 Mandai ..... G03G 15/065
2019/0286037 A1* 9/2019 Kimura ..... G03G 15/553

FOREIGN PATENT DOCUMENTS

JP 2009-294504 A 12/2009

* cited by examiner

*Primary Examiner* — Walter L Lindsay, Jr.
*Assistant Examiner* — Geoffrey T Evans
(74) *Attorney, Agent, or Firm* — IP Business Solutions, LLC

(57) ABSTRACT

An image forming apparatus includes a toner charge amount predictor, a toner developing resistance calculator, and a determiner. The toner developing resistance calculator calculates a toner developing resistance on the basis of a bias voltage applied to a developing device and a measured developing current by dividing a value of the bias voltage by a value of the developing current when a developing device develops an electrostatic latent image formed on the surface of an image carrier to form a toner image. The toner charge amount predictor predicts a toner charge amount of a toner which is supplied to the image carrier by the developing device on the basis of a density of the toner image and the developing current. The determiner determines a state of the developing device on the basis of the toner charge amount and the toner developing resistance.

3 Claims, 8 Drawing Sheets

Fig.4

| | | TONER CHARGE AMOUNT TQ[μC/g] | | | | |
|---|---|---|---|---|---|---|
| | | 0～10 | 10～20 | 20～30 | 30～40 | 40～50 |
| TONER DEVELOPING RESISTANCE TR[MΩ] | 0～5 | −6 | −9 | −12 | −15 | −18 |
| | 5～10 | −1 | −4 | −7 | −10 | −13 |
| | 10～15 | 4 | 1 | −2 | 7 | −8 |
| | 15～20 | 9 | 6 | 3 | 0 | −3 |
| | 20～25 | 14 | 11 | 8 | 5 | 2 |
| | 25～30 | 19 | 16 | 13 | 10 | 7 |

Fig.6

| CONDITIONS | FILLED AMOUNT | TONER CHARGE AMOUNT | TONER DEVELOPING RESISTANCE | ABNORMALITY LEVEL OF DEVELOPING DEVICE | | | DETERMINATION OF REPLACEMENT | | | DEVELOPING TONER AMOUNT | DETERMINATION OF DEVELOPING DEVICE |
|---|---|---|---|---|---|---|---|---|---|---|---|
| | [g] | TQ [μC/g] | TR[MΩ] | X | X1 | X2 | X | X1 | X2 | M[g/m²] | |
| 1-1 | 100 | 38 | 19.7 | 2.3 | 8.0 | 4.7 | BAD | BAD | BAD | 3.4 | BAD |
| 1-2 | 120 | 37 | 17.5 | 0.4 | 7.0 | 2.5 | BAD | BAD | BAD | 3.9 | BAD |
| 1-3 | 140 | 36 | 15.9 | −0.9 | 6.0 | 0.9 | GOOD | BAD | BAD | 4.4 | OK |
| 1-4 | 160 | 36 | 14.7 | −2.1 | 6.0 | −0.3 | GOOD | BAD | GOOD | 4.8 | OK |
| 1-5 | 180 | 34 | 14.4 | −1.8 | 4.0 | −0.6 | GOOD | BAD | GOOD | 5.2 | OK |
| 1-6 | 200 | 34 | 14.0 | −2.2 | 4.0 | −1.0 | GOOD | BAD | GOOD | 5.3 | OK |

Fig.7

| CONDITIONS | FILLED AMOUNT | TONER CHARGE AMOUNT | TONER DEVELOPING RESISTANCE | ABNORMALITY LEVEL OF DEVELOPING DEVICE | | | DETERMINATION OF REPLACEMENT | | | DEVELOPING TONER AMOUNT | DETERMINATION OF DEVELOPING DEVICE |
|---|---|---|---|---|---|---|---|---|---|---|---|
| | [g] | TQ [μC/g] | TR[MΩ] | X | X1 | X2 | X | X1 | X2 | M[g/m²] | |
| 2-1 | 100 | 30 | 19.3 | 4.3 | 0.0 | 4.3 | BAD | GOOD | BAD | 4.4 | BAD |
| 2-2 | 120 | 29 | 16.1 | 1.4 | -1.0 | 1.1 | BAD | GOOD | BAD | 5.4 | BAD |
| 2-3 | 140 | 29 | 13.7 | -1.0 | -1.0 | -1.3 | GOOD | GOOD | GOOD | 6.4 | GOOD |
| 2-4 | 160 | 29 | 12.2 | -2.5 | -1.0 | -2.8 | GOOD | GOOD | GOOD | 7.1 | GOOD |
| 2-5 | 180 | 28 | 11.6 | -2.8 | -2.0 | -3.4 | GOOD | GOOD | GOOD | 7.8 | GOOD |
| 2-6 | 200 | 28 | 11.3 | -3.1 | -2.0 | -3.7 | GOOD | GOOD | GOOD | 8.0 | GOOD |

IMAGE FORMING APPARATUS DETERMINING TONER REPLACEMENT TIMING

INCORPORATION BY REFERENCE

This application claims priority to Japanese Patent Application No. 2020-016348 filed on Feb. 3, 2020, the entire contents of which are incorporated by reference herein.

BACKGROUND

The present disclosure relates to an image forming apparatus and more particularly to a technique of determining a toner replacement timing.

An image forming apparatus including a developing means that develops an electrostatic latent image formed on an image carrier based on image data to form a toner image, a developing current detecting means that detects a developing current at the time of formation of the toner image, and a density sensor that detects an optical density of the toner image on an intermediate transfer member to which the toner image on the image carrier has been transferred is known. The image forming apparatus forms a patch image on the basis of patch image data, and measures an amount of electric charge of a toner contained in the developing means on the basis of the outputs of the density sensor and the developing current detecting means.

SUMMARY

An aspect of the disclosure proposes an improvement of the aforementioned technique.

An image forming apparatus according to an aspect of the disclosure includes an image carrier, a developing device, a density detecting device, a current measuring device, and a control device. The image carrier has an electrostatic latent image formed on a surface thereof. The developing device supplies a toner to the image carrier and develops the electrostatic latent image formed on the image carrier to form a toner image. The density detecting device detects a density of the toner image developed by the developing device. The current measuring device measures a developing current flowing in the developing device. The control device includes a processor and serves as a toner charge amount predictor, a toner developing resistance calculator, and a determiner by causing the processor to execute a control program. The toner charge amount predictor predicts a toner charge amount which is an amount of electric charge of the toner supplied to the image carrier by the developing device. The toner developing resistance calculator calculates a toner developing resistance on the basis of a bias voltage applied to the developing device and the developing current measured by the current measuring device when the electrostatic latent image is developed by the developing device. The determiner determines a state of the developing device on the basis of the toner charge amount predicted by the toner charge amount predictor and the toner developing resistance calculated by the toner developing resistance calculator. The toner charge amount predictor predicts the toner charge amount on the basis of the density detected by the density detecting device and the developing current. The toner developing resistance calculator calculates the toner developing resistance by dividing a value of the bias voltage by a value of the developing current.

BRIEF DESCRIPTION OF THE DRAWINGS

FIG. 4 is a diagram illustrating an abnormality table.

FIG. 6 is a table illustrating a determination result when the image forming apparatus according to the embodiment uses Developer A as a developer.

FIG. 7 is a table illustrating a determination result when the image forming apparatus according to the embodiment uses Developer B as a developer.

DETAILED DESCRIPTION

Figure 1:
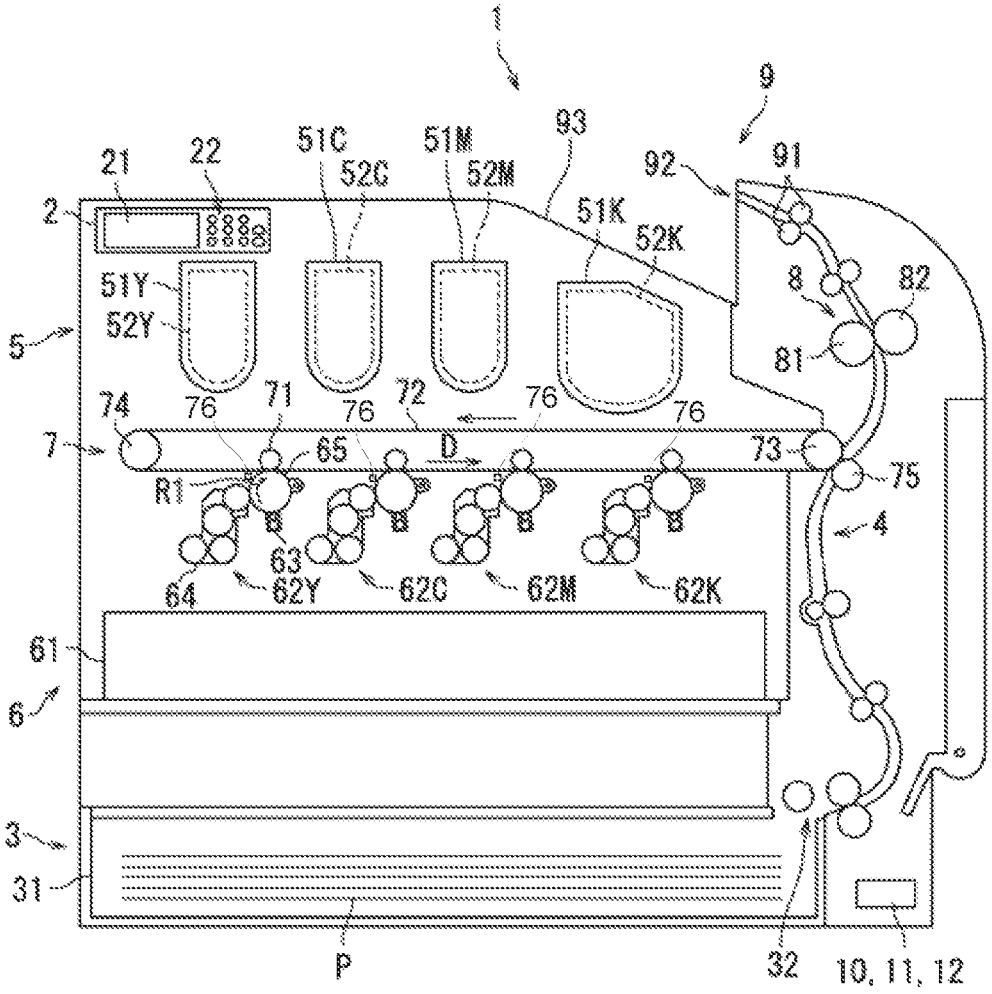
FIG. 1 is a diagram illustrating an example of a configuration of an image forming apparatus.

Hereinafter, an image forming apparatus according to an embodiment which is an aspect of the present disclosure will be described with reference to the accompanying drawings. In the drawings, the same or corresponding elements will be referred to by the same reference signs and description thereof will not be repeated.

A configuration of an image forming apparatus 1 according to an embodiment of the disclosure will be described below with reference to FIG. 1. FIG. 1 is a diagram illustrating an example of a configuration of the image forming apparatus 1. The image forming apparatus 1 is, for example, a tandem type color printer.

As illustrated in FIG. 1, the image forming apparatus 1 includes an operation device 2, a sheet feed device 3, a transport device 4, a toner supply device 5, an image forming device 6, a transfer device 7, a fixing device 8, a discharge device 9, and a control device 10.

The operation device 2 receives an instruction from a user. When the instruction from the user is received, the operation device 2 transmits a signal indicating the instruction from the user to the control device 10. The operation device 2 includes a liquid crystal display 21 and a plurality of operation keys 22. The liquid crystal display 21 displays, for example, various process results. The operation keys 22 include, for example, ten keys and a start key. When an instruction indicating execution of an image forming process is input, the operation device 2 transmits a signal indicating execution of the image forming process to the control device 10. As a result, an image forming operation is started by the image forming apparatus 1.

The sheet feed device 3 includes a sheet feed cassette 31 and a sheet feed roller group 32. The sheet feed cassette 31 can accommodate a plurality of paper sheets P therein. The sheet feed roller group 32 feeds the paper sheets P accommodated in the sheet feed cassette 31 to the transport device 4 sheet by sheet. The paper sheet P is an example of a recording medium.

The transport device 4 includes a roller and a guide member. The transport device 4 extends from the sheet feed device 3 to the discharge device 9. The transport device 4 transports a paper sheet P from the sheet feed device 3 to the discharge device 9 via the image forming device 6 and the fixing device 8.

The toner supply device 5 supplies a toner to the image forming device 6. The toner supply device 5 includes a first attachment device 51Y, a second attachment device 51C, a third attachment device 51M, and a fourth attachment device 51K. The toner supply device 5 is an example of a developer supply device. The toner is an example of a developer.

A first toner container 52Y is attached to the first attachment device 51Y. Similarly, a second toner container 52C is attached to the second attachment device 51C, a third toner container 52M is attached to the third attachment device 51M, and a fourth toner container 52K is attached to the fourth attachment device 51K. The configurations of the first to fourth attachment devices 51Y to 51K are different in a type of a toner container attached thereto and the other configurations are the same. Accordingly, the first to fourth attachment devices 51Y to 51K may be collectively referred to as "attachment devices 51."

The first toner container 52Y, the second toner container 52C, the third toner container 52M, and the fourth toner container 52K accommodate toners therein. In this embodiment, a yellow toner is accommodated in the first toner container 52Y. A cyan toner is accommodated in the second toner container 52C. A magenta toner is accommodated in the third toner container 52M. A black toner is accommodated in the fourth toner container 52K.

The image forming device 6 includes an exposure device 61, a first image forming unit 62Y, a second image forming unit 62C, a third image forming unit 62M, and a fourth image forming unit 62K.

Each of the first to fourth image forming units 62Y to 62K includes a charging device 63, a developing device 64, and a photosensitive drum 65. The photosensitive drum 65 is an example of an image carrier.

The charging device 63 and the developing device 64 are arranged along the circumferential surface of the photosensitive drum 65. In this embodiment, the photosensitive drum 65 rotates in a direction indicated by an arrow R1 in FIG. 1 (clockwise).

The charging device 63 uniformly charges the photosensitive drum 65 to a predetermined polarity by electrical discharge. In this embodiment, the charging device 63 charges the photosensitive drum 65 to a positive polarity. The exposure device 61 irradiates the charged photosensitive drum 65 with a laser beam. Accordingly, an electrostatic latent image is formed on the surface of the photosensitive drum 65.

The developing device 64 develops the electrostatic latent image formed on the surface of the photosensitive drum 65 to form a toner image. The developing device 64 is supplied with a toner from the toner supply device 5. The developing device 64 supplies the toner supplied from the toner supply device 5 to the surface of the photosensitive drum 65. As a result, the toner image is formed on the surface of the photosensitive drum 65.

In this embodiment, the developing device 64 of the first image forming unit 62Y is connected to the first attachment device 51Y. Accordingly, the developing device 64 of the first image forming unit 62Y is supplied with a yellow toner. Accordingly, a yellow toner image is formed on the surface of the photosensitive drum 65 of the first image forming unit 62Y.

The developing device 64 of the second image forming unit 62C is connected to the second attachment device 51C. Accordingly, the developing device 64 of the second image forming unit 62C is supplied with a cyan toner. Accordingly, a cyan toner image is formed on the surface of the photosensitive drum 65 of the second image forming unit 62C.

The developing device 64 of the third image forming unit 62M is connected to the third attachment device 51M. Accordingly, the developing device 64 of the third image forming unit 62M is supplied with a magenta toner. Accordingly, a magenta toner image is formed on the surface of the photosensitive drum 65 of the third image forming unit 62M.

The developing device 64 of the fourth image forming unit 62K is connected to the fourth attachment device 51K. Accordingly, the developing device 64 of the fourth image forming unit 62K is supplied with a black toner. Accordingly, a black toner image is formed on the surface of the photosensitive drum 65 of the fourth image forming unit 62K.

The transfer device 7 (an intermediate transfer device) repeatedly transfers the toner images formed on the surfaces of the photosensitive drums 65 of the first to fourth image forming units 62Y to 62K to a paper sheet P. In this embodiment, the transfer device 7 repeatedly transfers the toner images to the paper sheet P in a secondary transfer manner. Specifically, the transfer device 7 includes four primary transfer rollers 71, an intermediate transfer belt 72, a driving roller 73, a driven roller 74, a secondary transfer roller 75, and a density sensor 76.

The intermediate transfer belt 72 is an endless belt which is suspended on the four primary transfer rollers 71, the driving roller 73, and the driven roller 74. The intermediate transfer belt 72 is driven with rotation of the driving roller 73. In FIG. 1, the intermediate transfer belt 72 rotates in a counterclockwise direction. The driven roller 74 is rotationally driven with the rotation of the intermediate transfer belt 72.

The first to fourth image forming units 62Y to 62K are arranged to face the bottom surface of the intermediate transfer belt 72 in a driving direction D of the bottom surface of the intermediate transfer belt 72. In this embodiment, the first to fourth image forming units 62Y to 62K are arranged from upstream to downstream in the driving direction D of the bottom surface of the intermediate transfer belt 72 in the order of the first to fourth image forming units 62Y to 62K.

Each primary transfer roller 71 is disposed to face the photosensitive drum 65 with the intermediate transfer belt 72 interposed therebetween and is pressed against the photosensitive drum 65. Accordingly, the toner images formed on the surfaces of the photosensitive drums 65 are sequentially transferred to the intermediate transfer belt 72. In this embodiment, the yellow toner image, the cyan toner image, the magenta toner image, and the black toner image are sequentially repeatedly transferred to the intermediate transfer belt 72. In the following description, a toner image formed by superimposing the yellow toner image, the cyan toner image, the magenta toner image, and the black toner image may be referred to as a "stacked toner image."

The secondary transfer roller 75 is disposed to face the driving roller 73 with the intermediate transfer belt 72 interposed therebetween. The secondary transfer roller 75 is pressed against the driving roller 73. Accordingly, a transfer nip is formed between the secondary transfer roller 75 and the driving roller 73. When a paper sheet P passes through the transfer nip, the stacked toner image on the intermediate transfer belt 72 is transferred to the paper sheet P. In this embodiment, the yellow toner image, the cyan toner image, the magenta toner image, and the black toner image are transferred to the paper sheet P such that the toner images are stacked from a top layer to a bottom layer in that order. The paper sheet P to which the stacked toner image has been transferred is transported to the fixing device 8 by the transport device 4.

The density sensor 76 (a density detecting device) is provided in each of the first to fourth image forming units 62Y to 62K. The density sensor 76 is disposed to face the surface of the photosensitive drum 65 downstream from the developing device 64 in the rotating direction of the photosensitive drum 65. The density sensor 76 measures a density of a toner image formed on the photosensitive drum 65.

The fixing device 8 includes a heating member 81 and a pressurizing member 82. The heating member 81 and the pressurizing member 82 are arranged to face each other and form a fixing nip. The paper sheet P transported from the image forming device 6 is heated to a predetermined fixing temperature and pressurized while passing through the fixing nip. As a result, the stacked toner image is fixed to the paper sheet P. The paper sheet P is transported from the fixing device 8 to the discharge device 9 by the transport device 4.

The discharge device 9 includes a discharge roller pair 91 and a discharge tray 93. The discharge roller pair 91 transports the paper sheet P to the discharge tray 93 via a discharge port 92. The discharge port 92 is formed in the top of the image forming apparatus 1.

The control device 10 controls operations of the constituent devices of the image forming apparatus 1. The control device 10 includes a processor 11 and a storage device 12. The processor 11 includes, for example, a central processing unit (CPU). The storage device 12 may include a memory such as a semiconductor memory or a hard disk drive (HDD). The storage device 12 stores a control program. The processor 11 controls the operation of the image forming apparatus 1 by executing the control program. The processor 11 serves as a toner charge amount predictor 647, a toner developing resistance calculator 649, and a determiner 650 which will be described later with reference to FIG. 2, by executing the control program.

Figure 2:
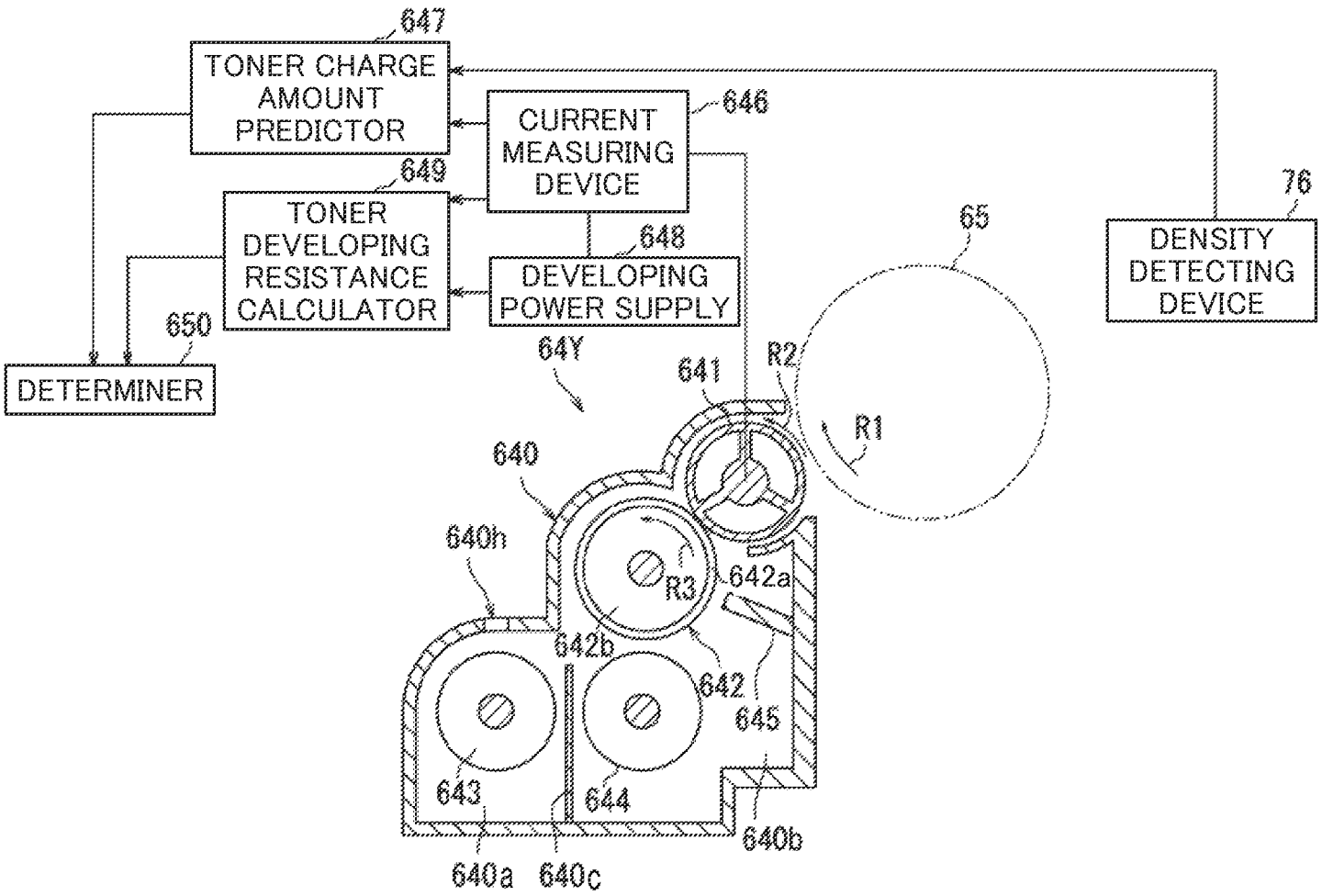
FIG. 2 is a diagram illustrating an example of a configuration of a developing device.

The configuration of the developing device 64 will be described below in detail with reference to FIG. 2. FIG. 2 is a diagram illustrating an example of a configuration of the developing device 64. Specifically, FIG. 2 illustrates the first developing device 64Y of the first image forming unit 62Y. In FIG. 2, the photosensitive drum 65 is illustrated by a two-dot chain line for the purpose of easy understanding. In this embodiment, the first developing device 64Y develops an electrostatic latent image formed on the surface of the photosensitive drum 65 in a touch-down developing manner. As described above with reference to FIG. 1, the developing container 640 of the first developing device 64Y is connected to the first toner container 52Y. Accordingly, a yellow toner is supplied to the developing container 640 of the first developing device 64Y via a toner supply port 640*h*.

As illustrated in FIG. 2, the first developing device 64Y includes a developing roller 641, a magnetic roller 642, a first agitating screw 643, a second agitating screw 644, and a blade 645 in the developing container 640. Specifically, the developing roller 641 is disposed to face the magnetic roller 642. The magnetic roller 642 is disposed to face the second agitating screw 644. The blade 645 is disposed to face the magnetic roller 642.

The developing container 640 is partitioned into a first agitating chamber 640*a* and a second agitating chamber 640*b* by a partition wall 640*c*. The partition wall 640*c* extends in an extending direction of a rotation shaft of the developing roller 641. The first agitating chamber 640*a* and the second agitating chamber 640*b* communicate with each other outside of both ends in the length direction of the partition wall 640*c*.

The first agitating screw 643 is disposed in the first agitating chamber 640*a*. A carrier of a magnetic material is accommodated in the first agitating chamber 640*a*. A toner of a nonmagnetic material is supplied to the first agitating chamber 640*a* via the toner supply port 640*h*. In the example illustrated in FIG. 2, a yellow toner is supplied to the first agitating chamber 640*a*.

The second agitating screw 644 is disposed in the second agitating chamber 640*b*. A carrier of a magnetic material is accommodated in the second agitating chamber 640*b*.

The yellow toner is agitated and mixed with the carrier by the first agitating screw 643 and the second agitating screw 644. As a result, a two-component developer including the carrier and the yellow toner is formed. The two-component developer is an example of a developer and thus may be simply referred to as a "developer" in the following description.

The first agitating screw 643 and the second agitating screw 644 agitate the developer by circulating the developer between the first agitating chamber 640*a* and the second agitating chamber 640*b*. As a result, the toner is charged to a predetermined polarity. In this embodiment, the toner is charged to a positive polarity.

The magnetic roller 642 includes a nonmagnetic rotation sleeve 642*a* and a magnet member 642*b*. The magnet member 642*b* is fixed in the rotation sleeve 642*a*. The magnet member 642*b* includes a plurality of magnetic poles. The developer is adsorbed on the magnetic roller 642 by a magnetic force of the magnet member 642*b*. As a result, a magnetic brush is formed on the surface of the magnetic roller 642.

In this embodiment, the magnetic roller 642 rotates in a direction indicated by an arrow R3 in FIG. 2 (counterclockwise). The magnetic roller 642 transports the magnetic brush to a position facing the blade 645 by rotating. The blade 645 is disposed to form a gap along with the magnetic roller 642. Accordingly, the thickness of the magnetic brush is defined by the blade 645. The blade 645 is disposed upstream in the rotating direction of the magnetic roller 642 from the position at which the magnetic roller 642 and the developing roller 641 face each other.

A predetermined voltage is applied to the developing roller 641 and the magnetic roller 642. When the predetermined voltage is applied and a potential difference between the developing roller 641 and the magnetic roller 642 reaches a predetermined value, the yellow toner included in the developer moves to the developing roller 641. As a result, a thin toner layer formed of the yellow toner is formed on the surface of the developing roller 641.

The developing roller 641 rotates in a direction indicated by an arrow R2 (counterclockwise) in FIG. 2. Accordingly, the thin toner layer formed on the surface is transported to the position facing the photosensitive drum 65 and is attached to the photosensitive drum 65.

The first developing device 64Y includes a current measuring device 646. The first developing device 64Y is connected to the toner charge amount predictor 647, the toner developing resistance calculator 649, and the determiner 650 of the control device 10.

The current measuring device 646 is constituted, for example, by an ammeter and measures a current value of a developing current. The current measuring device 646 is connected, for example, between a developing power supply 648 and the developing roller 641. The developing power supply 648 applies a predetermined bias voltage to the developing roller 641. The current measuring device 646 measures a developing current flowing between the photosensitive drum 65 and the developing roller 641 on the basis of the bias voltage applied by the developing power supply 648.

The toner charge amount predictor 647 predicts a toner charge amount TQ which is an amount of electric charge of the toner supplied to the photosensitive drum 65 by the first developing device 64Y.

Specifically, the toner charge amount predictor 647 acquires a developing current Id which is measured by the current measuring device 646 when the first developing device 64Y develops the electrostatic latent image, and calculates a developing charge amount Q by integrating the acquired developing current Id with time.

The toner charge amount predictor 647 acquires a density of a toner image (a toner density C) formed on the photosensitive drum 65 which is measured by the density sensor 76. The toner charge amount predictor 647 converts the acquired toner density C into a developing toner amount M, for example, with reference to a density table indicating a correspondence between the toner density C and a developing toner amount M which is stored in the storage device 12.

The toner charge amount predictor 647 calculates a ratio of the developing charge amount Q and the developing toner amount M as the toner charge amount TQ.

In this embodiment, a process of calculating the toner charge amount TQ may be performed on the basis of a toner image which is formed by the first developing device 64Y to develop an electrostatic latent image corresponding to a reference image which is prepared for calculating the toner charge amount TQ or may be performed on the basis of a toner image which is formed by developing the electrostatic latent image corresponding to an image which is formed on the paper sheet P.

Here, the toner charge amount TQ changes with deterioration of a developer depending on a temperature, a humidity, a coverage ratio of an image printed on a paper sheet P, the number of printed paper sheets P, and the like. For example, in a low-temperature low-humidity environment, the toner charge amount TQ increases excessively. As a result, a density of an image (an image density) which is formed in the image forming apparatus decreases.

For example, even when the toner charge amount TQ changes due to control of the toner density in the developer, it is possible to maintain an appropriate toner density and to curb a decrease in image density.

However, the image density also decreases due to carrier developing in which the carrier in the developer as well as the toner also moves to the photosensitive drum 65 in addition to an increase of the toner charge amount TQ.

Specifically, even when the toner density in the developer is controlled, the amount of toner decreases with a decrease in the amount of carrier in the developer due to the carrier developing. As a result, an amount of developer decreases and the image density decreases in the image forming apparatus.

When the image density decreases due to the decrease of the amount of developer, it is necessary to complement the amount of developer by replacing the developing device 64 or the like.

This decrease of the amount of developer cannot be detected even when the toner charge amount TQ is predicted. Accordingly, when the decrease of the amount of developer is checked, a method other than the method used for predicting the toner charge amount TQ needs to be used.

For example, when the amount of developer decreases, the amount of carrier decreases and thus the developing current decreases. Therefore, a toner developing resistance indicating a degree of flowing difficulty of the developing current is calculated by the toner developing resistance calculator 649. When the toner developing resistance is large, the developing current decreases, which represents that the amount of carrier (the amount of developer) decreases.

In this embodiment, the toner developing resistance calculator 649 calculates a toner developing resistance on the basis of the bias voltage applied to the first developing device 64Y and the developing current measured by the current measuring device 646 when the first developing device 64Y develops an electrostatic latent image.

Specifically, the toner developing resistance calculator 649 acquires a bias voltage Vdc which is applied to the developing roller 641 by the developing power supply 648. The toner developing resistance calculator 649 acquires the developing current Id when the first developing device 64Y develops the electrostatic latent image, which is measured by the current measuring device 646. The toner developing resistance calculator 649 calculates a toner developing resistance TR by dividing the acquired bias voltage Vdc by the developing current Id.

In this embodiment, the process of calculating the toner developing resistance TR may be performed when the first developing device 64Y develops an electrostatic latent image corresponding to a reference image which is prepared for calculating the toner developing resistance TR or may be performed when the first developing device 64Y develops the electrostatic latent image corresponding to an image which is formed on the paper sheet P.

The determiner 650 determines a state of the developing device 64 on the basis of the toner charge amount TQ predicted by the toner charge amount predictor 647 and the toner developing resistance TR calculated by the toner developing resistance calculator 649.

For example, the toner developing resistance calculator 649 may calculate a plurality of toner developing resistances on the basis of each of the developing currents corresponding to a plurality of bias voltages and determine one toner developing resistance which is used for the determiner 650 to determine the state of the developing device 64 on the basis of the calculated toner developing resistances.

Specifically, when a bias voltage Vdc1 is applied to the first developing device 64Y, the toner developing resistance calculator 649 acquires a developing current Id1 measured by the current measuring device 646 and calculates a toner developing resistance TR1. When a bias voltage Vdc2 is applied to the first developing device 64Y, the toner developing resistance calculator 649 acquires a developing current Id2 measured by the current measuring device 646 and calculates a toner developing resistance TR2. When a bias voltage Vdc3 is applied to the first developing device 64Y, the toner developing resistance calculator 649 acquires a developing current Id3 measured by the current measuring device 646 and calculates a toner developing resistance TR3.

The toner developing resistance calculator 649 calculates a linear function on the basis of the calculated toner developing resistances TR1, TR2, and TR3, for example, using a least square method and determines the slope of the calculated linear function as the toner developing resistance TR which is used for the determiner 650 to determine the state of the developing device 64.

In this embodiment, the toner developing resistance calculator 649 calculates the linear function on the basis of the calculated toner developing resistances TR1, TR2, and TR3, but the disclosure is not limited thereto and a function such as a quadratic function other than the linear function may be calculated and some parameters of the calculated function may be determined as the toner developing resistance TR which is used for the determiner 650 to determine the state of the developing device 64.

A process of determining a developing device state which is performed by the determiner 650 will be described below.

(Determination Method 1)

The determiner 650 calculates an abnormality level indicating a degree of abnormality of the first developing device 64Y on the basis of a function FT indicating a correspondence between a toner charge amount and a toner developing resistance.

Figure 3:
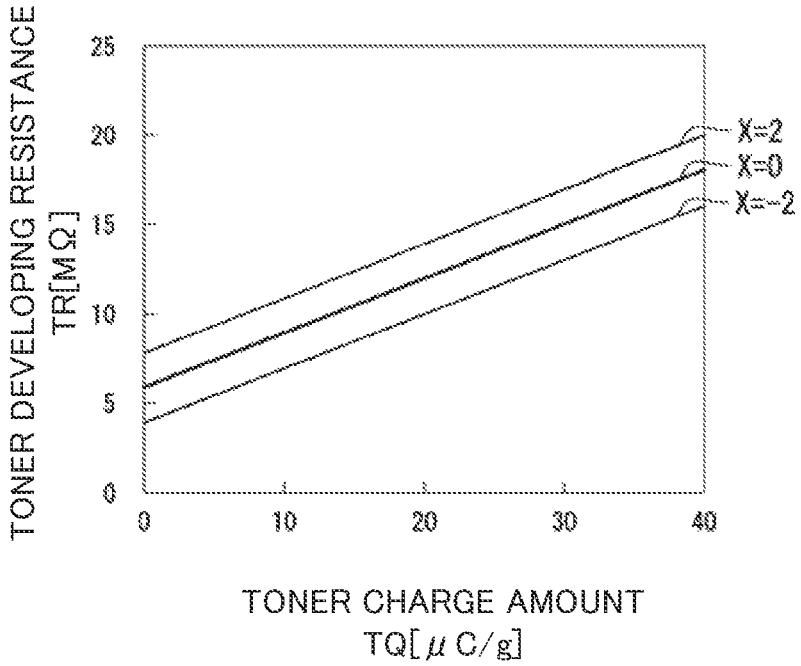
FIG. 3 is a graph of a function.

The function FT indicating a correspondence between a toner charge amount TQx and a toner developing resistance TRx and an abnormality level X will be described below with reference to FIGS. 1 to 3. FIG. 3 is a graph illustrating the function FT. In FIG. 3, the horizontal axis represents the toner charge amount TQx and the vertical axis represents the toner developing resistance TRx. The function FT is, for example, a linear function ($TRx=\alpha*TQx+\beta$).

In this embodiment, the function FT is stored in the storage device 12. The determiner 650 acquires the function FT from the storage device 12, and calculates the abnormality level X ($X=TRx-\alpha*TQx-\beta$) by substituting the toner charge amount TQ predicted by the toner charge amount predictor 647 and the toner developing resistance TR calculated by the toner developing resistance calculator 649 into the toner charge amount TQx and the toner developing resistance TRx of the acquired function FT.

FIG. 3 illustrates "0," "2," and "−2" as an example of the abnormality level X calculated by the determiner 650.

The determiner 650 determines the state of the first developing device 64Y on the basis of the calculated abnormality level X. For example, when the calculated abnormality level X is "−2" ($X<0$), the determiner 650 determines that the state of the first developing device 64Y is normal. On the other hand, when the calculated abnormality level X is "0" or "2" ($X\geq 0$), the determiner 650 determines that the state of the first developing device 64Y is abnormal (replacement is necessary).

In this embodiment, the function FT is a linear function, but the disclosure is not limited thereto and the function FT may be a quadratic function or the like.

(Determination Method 2)

The determiner 650 determines the state of the first developing device 64Y on the basis of an abnormality table indicating a correspondence between a combination of the toner charge amount TQ and the toner developing resistance TR and the abnormality level X.

The abnormality table will be described below with reference to FIGS. 1, 2, and 4. FIG. 4 is a diagram illustrating an abnormality table.

In this embodiment, the abnormality table is stored in the storage device 12. The determiner 650 acquires the abnormality level X corresponding to a combination of the toner charge amount TQ predicted by the toner charge amount predictor 647 and the toner developing resistance TR calculated by the toner developing resistance calculator 649 with reference to the abnormality table in the storage device 12, and determines the state of the first developing device 64Y on the basis of the acquired abnormality level X. The determiner 650 determines that the state of the first developing device 64Y is abnormal (replacement is necessary) when the abnormality level X is greater than a predetermined threshold value A, and determines that the state of the first developing device 64Y is normal when the abnormality level X is not greater than the predetermined threshold value A.

(Determination Method 3)

The determiner 650 stores the toner charge amount TQ and the toner developing resistance TR in the storage device 12 and determines the state of the first developing device 64Y on the basis of the stored toner charge amount TQ and the stored toner developing resistance TR using a statistical method.

For example, the determiner 650 calculates a value indicating to what extent the calculated toner charge amount TQ and the calculated toner developing resistance TR are deviated from average distributions of the toner charge amount TQ and the toner developing resistance TR stored in the storage device 12 as an abnormality level X, and determines the state of the first developing device 64Y on the basis of the calculated abnormality level X. The determiner 650 determines that the state of the first developing device 64Y is abnormal (replacement is necessary) when the abnormality level X is greater than a predetermined threshold value B, and determines that the state of the first developing device 64Y is normal when the abnormality level X is not greater than the predetermined threshold value B.

For example, when a toner charge amount TQ and a toner developing resistance TR of another image forming apparatus of the same type as the image forming apparatus 1 are stored in a storage device outside of the image forming apparatus 1, the determiner 650 calculates a value indicating to what extent the calculated toner charge amount and the calculated toner developing resistance are deviated from average distributions of the toner charge amount TQ and the toner developing resistance TR stored in the storage device outside of the image forming apparatus 1 as an abnormality level X, and determines the state of the first developing device 64Y in the same way as described above on the basis of the calculated abnormality level X.

When the determiner 650 determines that the state of the first developing device 64Y is abnormal, the control device 10 performs a process of displaying a notification for notifying a user of replacement of the first developing device 64Y on the liquid crystal display 21.

The configurations of the developing devices 64 provided in the first to fourth image forming units 62Y to 62K are different in only the types of toners supplied thereto from the toner supply device 5 and are substantially the same in the other configurations. Accordingly, description of the configurations of the second to fourth developing devices 64C to 64K of the second to fourth image forming units 62C to 62K will be omitted. Determination of the states of the second to fourth developing devices 64C to 64K is performed in the same way as determining the state of the first developing device 64Y.

The determiner 650 may calculate the abnormality level on the basis of another factor in addition to the toner charge amount and the toner developing resistance. For example, the determiner 650 acquires a value of a voltage applied from the transfer device 7 to the primary transfer roller 71 of the first image forming unit 62Y and a value of a current flowing in the transfer device 7 for the application, and calculates an abnormality level on the basis of a transfer resistance value based on the acquired value of the voltage and the acquired value of the current, the toner charge amount, and the toner developing resistance. In this case, for example, the determiner 650 calculates a value indicating to what extent the calculated toner charge amount TQ, the calculated toner developing resistance TR, and the calculated transfer resistance value are deviated from average distributions of the toner charge amount TQ, the toner developing resistance TR, and the transfer resistance value stored in the storage device 12 as an abnormality level X, and determines the state of the first developing device 64Y on the basis of the calculated abnormality level X.

In this embodiment, the toner charge amount predictor 647, the toner developing resistance calculator 649, and the determiner 650 may be provided in the first image forming unit 62Y. In this case, a processor provided in the first image forming unit 62Y serves as the toner charge amount predictor 647, the toner developing resistance calculator 649, and the determiner 650 by executing an operation program stored in a storage device such as a memory provided in the first image forming unit 62Y.

Figure 5:
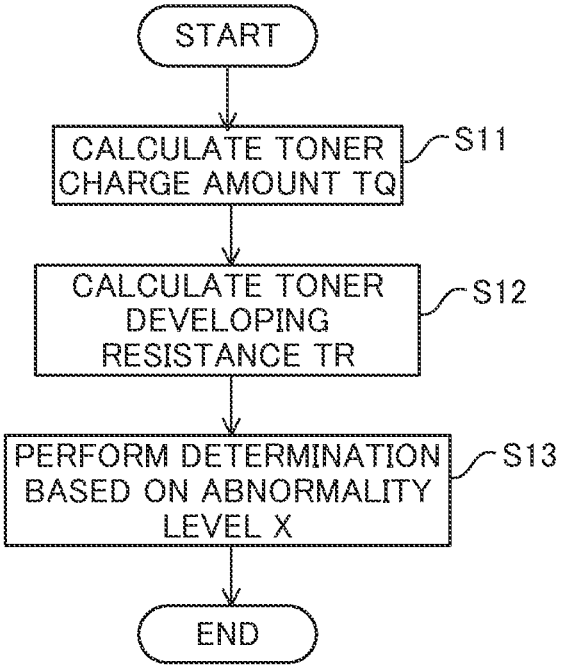
FIG. 5 is a flowchart illustrating a determination process according to an embodiment.

A determination process according to this embodiment will be described below with reference to FIG. 5. FIG. 5 is a flowchart illustrating a determination process according to this embodiment.

First, the toner charge amount predictor 647 acquires a developing current Id when the first developing device 64Y develops an electrostatic latent image, which is measured by the current measuring device 646, and a toner density C of a stacked toner image formed on the photosensitive drum 65, which is measured by the density sensor 76. The toner charge amount predictor 647 calculates a ratio of a developing charge amount Q obtained by integrating the acquired developing current Id over time and a developing toner amount M obtained by converting the acquired toner density C with reference to a density table as a toner charge amount TQ (Step S11).

The toner developing resistance calculator 649 acquires the bias voltage Vdc applied to the developing roller 641 by the developing power supply 648 and the developing current Id when the first developing device 64Y develops the electrostatic latent image, which is measured by the current measuring device 646. The toner developing resistance calculator 649 calculates a toner developing resistance TR by dividing the acquired bias voltage Vdc by the developing current Id (Step S12).

The determiner 650 calculates the abnormality level X on the basis of the toner charge amount TQ and the toner developing resistance TR and determines the state of the first developing device 64Y on the basis of the calculated abnormality level X (Step S13).

In general, an image forming apparatus that can curb a decrease in optical density of a toner image by controlling a density of a toner accommodated in a developing device on the basis of a measured toner charge amount is known. However, when a decrease in optical density of a toner image is curbed and an amount of toner accommodated in the developing device decreases, the optical density of the toner image decreases. In this case, since the toner needs to be replaced, it is preferable to accurately determine a replacement timing of a toner. On the other hand, according to this embodiment, it is possible to accurately determine a replacement timing of a toner.

EXAMPLE 1

The disclosure will be specifically described below on the basis of examples, and the disclosure is not limited to the examples.

In examples and comparative examples of the disclosure, a multifunction machine was used as the image forming apparatus 1. The multifunction machine was a modified machine of TASK alfa 2550 Ci (Kyocera Document Solutions Corporation).

Experiment conditions of the multifunction machine were as follows.

Photosensitive drum 65: amorphous silicon drum
Thickness of photosensitive layer of photosensitive drum 65: 20 μm
Blade 645: SUS430, magnetic
Thickness of blade 645: 1.5 mm
Surface shape of developing roller 641: knurling+blast
Outer diameter of developing roller 641: 20 mm
Recess of developing roller 641: 64 lines in the circumferential direction, V grooves
Circumferential speed of developing roller 641/circumferential speed of photosensitive drum 65: 1.8
Distance between developing roller 641 and photosensitive drum 65: 0.3 mm
AC component of bias voltage Vdc: Vpp 1200 V, duty 50%, rectangular wave, 8 kHz
Toner: particle diameter 6.8 μm, positive polarity
Carrier: particle diameter 38 μm, ferrite/resin-coated carrier
Toner density: 6%
Printing speed: 55 sheets/min Reference examples and comparative examples will be described below with comparison.

In Example 1, a function FT for calculating an abnormality level X in a developing device 64 was defined as X=TRx−0.3*TQx−6. In Comparative Example 1, an abnormality level X1 was defined as XA=TQx−30. In Comparative Example 1, the abnormality level X1 was calculated on the basis of only a toner charge amount TQ. In Comparative Example 2, an abnormality level X2 was defined as X2=TRx−15. In Comparative Example 2, the abnormality level X2 was calculated on the basis of only a toner developing resistance TR.

A first example of a determination result using the image forming apparatus 1 according to this embodiment will be described below with reference to FIG. 6. FIG. 6 is a table illustrating the determination result when developer A is used as a developer of the image forming apparatus 1 according to this embodiment.

In the table illustrated in FIG. 6, the calculated toner charge amount TQ, the calculated toner developing resistance TR, the calculated abnormality levels X, X1, and X2, and determination results (replacement determination) based on the abnormality levels X, X1, and X2 in six steps of conditions of an amount of developer (filling amount) of developer A are illustrated. When the abnormality levels X, X1, and X2 are greater than zero, it is determined to be abnormal and "BAD" is written in "replacement determination" in the table illustrated in FIG. 6. When the abnormality levels X, X1, and X2 are equal to or less than zero, it is determined to be normal and "GOOD" is written in "replacement determination" in the table illustrated in FIG. 6.

Specifically, in Condition 1-1, when the amount of developer is 100 [g], the calculated toner charge amount TQ is 38 [μC/g], the calculated toner developing resistance TR is 19.7 [MΩ], the calculated abnormality level X is "2.3," the abnormality level X1 is "8.0," and the abnormality level X2 is "4.7." The determination result based on the abnormality level X is "BAD" the determination result based on the abnormality level X1 is "BAD" and the determination result based on the abnormality level X2 is "BAD"

In order to verify whether the determination results are valid, a developing toner amount M is described in the table illustrated in FIG. 6. The developing toner amount M is an amount of toner which is developed on the photosensitive drum 65 when a bias voltage (220 V) is applied to the developing roller 641. Whether replacement of the developing device 64 is necessary is determined on the basis of the developing toner amount M and the amount of developer of developer A filled in the developing device 64, and a determination result thereof is written in "determination of developing device" in the table illustrated in FIG. 6

For example, when the developing toner amount M is equal to or greater than 5.5 [g/m$^2$], it is determined that the image density is sufficient and replacement of the developing device 64 is not necessary (determination of developing device "GOOD"). When the developing toner amount M is less than 5.5 [g/m$^2$] and the amount of developer is equal to or greater than 130 [g], it is determined that the image density is insufficient, the amount of developer is sufficient, and replacement of the developing device 64 is not necessary (determination of developing device "OK"). When the developing toner amount M is less than 5.5 [g/m$^2$] and the amount of developer is less than 130 [g], it is determined that the image density and the amount of developer are insufficient and replacement of the developing device 64 is necessary (determination of developing device "BAD").

In Condition 1-1, since the amount of developer is 100 [g] (<130 [g]) and the developing toner amount M is 3.4 [g/m$^2$] (<5.5 [g/m$^2$]), it is determined that replacement of the developing device 64 is necessary (determination of developing device "BAD").

In Condition 1-2, when the amount of developer is 120 [g], the toner charge amount TQ is 37 [μC/g], the calculated toner developing resistance TR is 17.5 [MΩ], the abnormality level X is "0.4," the abnormality level X1 is "7.0," and the abnormality level X2 is "2.5." The determination result based on the abnormality level X is "BAD" the determination result based on the abnormality level X1 is "BAD" and the determination result based on the abnormality level X2 is "BAD". Since the amount of developer is 120 [g] (<130 [g]) and the developing toner amount M is 3.9 [g/m$^2$] (<5.5 [g/m$^2$]), it is determined that replacement of the developing device 64 is necessary (determination of developing device "BAD").

In Condition 1-3, when the amount of developer is 140 [g], the calculated toner charge amount TQ is 36 [μC/g], the calculated toner developing resistance TR is 15.9 [MΩ], the abnormality level X is "−0.9", the abnormality level X1 is "6.0," and the abnormality level X2 is "0.9", The determination result based on the abnormality level X is "GOOD" the determination result based on the abnormality level X1 is "BAD" and the determination result based on the abnormality level X2 is "BAD". Since the developing toner amount M is 4.4 [g/m$^2$] (<5.5 [g/m$^2$]) and the amount of developer is 140 [g] (≥130 [g]), it is determined that replacement of the developing device 64 is not necessary (determination of developing device "OK").

In Condition 1-4, when the amount of developer is 160 [g], the calculated toner charge amount TQ is 36 [μC/g], the calculated toner developing resistance TR is 14.7 [MΩ], the abnormality level X is "−2.1", the abnormality level X1 is "6.0", and the abnormality level X2 is "−0.3". The determination result based on the abnormality level X is "GOOD" the determination result based on the abnormality level X1 is "BAD" and the determination result based on the abnormality level X2 is "GOOD". Since the developing toner amount M is 4.8 [g/m$^2$] (<5.5 [g/m$^2$]) and the amount of developer is 160 [g] (≥130 [g]), it is determined that replacement of the developing device 64 is not necessary (determination of developing device "OK").

In Condition 1-5, when the amount of developer is 180 [g], the calculated toner charge amount TQ is 34 [μC/g], the calculated toner developing resistance TR is 14.4 [MΩ], the abnormality level X is "−1.8", the abnormality level X1 is "4.0", and the abnormality level X2 is "−0.6". The determination result based on the abnormality level X is "GOOD" the determination result based on the abnormality level X1 is "BAD" and the determination result based on the abnormality level X2 is "GOOD". Since the developing toner amount M is 5.2 [g/m$^2$] (<5.5 [g/m$^2$]) and the amount of developer is 180 [g] (≥130 [g]), it is determined that replacement of the developing device 64 is not necessary (determination of developing device "OK").

In Condition 1-6, when the amount of developer is 200 [g], the calculated toner charge amount TQ is 34 [μC/g], the calculated toner developing resistance TR is 14.0 [MΩ], the abnormality level X is "−2.2", the abnormality level X1 is "4.0," and the abnormality level X2 is "−1.0". The determination result based on the abnormality level X is "GOOD" the determination result based on the abnormality level X1 is "BAD" and the determination result based on the abnormality level X2 is "GOOD". Since the developing toner amount M is 5.3 [g/m$^2$] (<5.5 [g/m$^2$]) and the amount of developer is 200 [g] (≥130 [g]), it is determined that replacement of the developing device 64 is not necessary (determination of developing device "OK").

A second example of the determination result using the image forming apparatus 1 according to this embodiment will be described below with reference to FIG. 7. FIG. 7 is a table illustrating the determination result when developer B is used as a developer of the image forming apparatus 1 according to this embodiment.

In the table illustrated in FIG. 7, determination results of the same determination as in the table illustrated in FIG. 6 using developer B are illustrated.

In Condition 2-1, when the amount of developer is 100 [g], the calculated toner charge amount TQ is 30 [μC/g], the calculated toner developing resistance TR is 19.3 [MΩ], the abnormality level X is "4.3", the abnormality level X1 is "0.0", and the abnormality level X2 is "4.3". The determination result based on the abnormality level X is "BAD" the determination result based on the abnormality level X1 is "GOOD" and the determination result based on the abnormality level X2 is "BAD". Since the amount of developer is 100 [g] (<130 [g]) and the developing toner amount M is 4.4 [g/m$^2$] (<5.5 [g/m$^2$]), it is determined that replacement of the developing device 64 is necessary (determination of developing device "BAD").

In Condition 2-2, when the amount of developer is 120 [g], the calculated toner charge amount TQ is 29 [μC/g], the calculated toner developing resistance TR is 16.1 [MΩ], the abnormality level X is "1.4", the abnormality level X1 is "−1.0", and the abnormality level X2 is "1.1". The determination result based on the abnormality level X is "BAD" the determination result based on the abnormality level X1 is "GOOD" and the determination result based on the abnormality level X2 is "BAD". Since the amount of developer is 120 [g] (<130 [g]) and the developing toner amount M is 5.4 [g/m$^2$] (<5.5 [g/m$^2$]), it is determined that replacement of the developing device 64 is necessary (determination of developing device "BAD").

In Condition 2-3, when the amount of developer is 140 [g], the calculated toner charge amount TQ is 29 [μC/g], the calculated toner developing resistance TR is 13.7 [MΩ], the abnormality level X is "−1.0", the abnormality level X1 is "−1.0", and the abnormality level X2 is "−1.3." The determination result based on the abnormality level X is "GOOD" the determination result based on the abnormality level X1 is "GOOD" and the determination result based on the abnormality level X2 is "GOOD". Since the amount of developer is 140 [g] (≥130 [g]) and the developing toner amount M is 6.4 [g/m$^2$] (≥0.5 [g/m$^2$]), it is determined that replacement of the developing device 64 is not necessary (determination of developing device "GOOD").

In Condition 2-4, when the amount of developer is 160 [g], the calculated toner charge amount TQ is 29 [μC/g], the calculated toner developing resistance TR is 12.2 [MΩ], the abnormality level X is "−2.5", the abnormality level X1 is "−1.0", and the abnormality level X2 is "−2.8". The determination result based on the abnormality level X is "GOOD" the determination result based on the abnormality level X1 is "GOOD" and the determination result based on the abnormality level X2 is "GOOD" Since the amount of developer is 160 [g] (≥130 [g]) and the developing toner amount M is 7.1 [g/m$^2$] (0.5 [g/m$^2$]), it is determined that replacement of the developing device 64 is not necessary (determination of developing device "GOOD").

In Condition 2-5, when the amount of developer is 180 [g], the calculated toner charge amount TQ is 28 [μC/g], the calculated toner developing resistance TR is 11.6 [MΩ], the abnormality level X is "−2.8", the abnormality level X1 is "−2.0", and the abnormality level X2 is "−3.4". The determination result based on the abnormality level X is "GOOD" the determination result based on the abnormality level X1 is "GOOD" and the determination result based on the abnormality level X2 is "GOOD". Since the amount of developer is 180 [g] (≥130 [g]) and the developing toner amount M is 7.8 [g/m$^2$] (≥0.5 [g/m$^2$]), it is determined that replacement of the developing device 64 is not necessary (determination of developing device "GOOD").

In Condition 2-6, when the amount of developer is 200 [g], the calculated toner charge amount TQ is 28 [μC/g], the calculated toner developing resistance TR is 11.3 [MΩ], the abnormality level X is "−3.1", the abnormality level X1 is "−2.0", and the abnormality level X2 is "−3.7". The determination result based on the abnormality level X is "GOOD" the determination result based on the abnormality level X1 is "GOOD" and the determination result based on the abnormality level X2 is "GOOD". Since the amount of developer is 200 [g] (≥130 [g]) and the developing toner amount M is 8.0 [g/m$^2$] (≥0.5 [g/m$^2$]), it is determined that replacement of the developing device 64 is not necessary (determination of developing device "GOOD").

Figure 8:
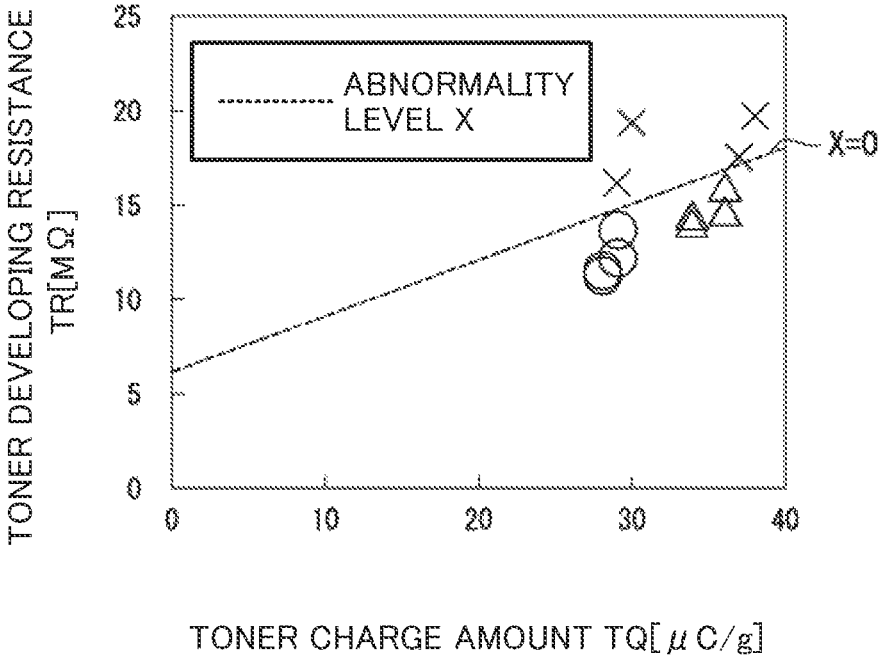
FIG. 8 is a diagram in which "determination of developing device" is plotted on the graph illustrated in FIG. 3.

Validity of the determination results based on the toner charge amounts TQ and the toner developing resistances TR will be described below with reference to FIGS. 6 to 8. FIG. 8 is a diagram in which "determination of developing device" is plotted on the graph illustrated in FIG. 3.

As illustrated in FIGS. 6 and 7, in comparison between the determination result based on the abnormality level X1 and the determination of developing device, the determination result and the determination of developing device may be different from each other when the toner charge amount TQ is equal to or less than 30 [μC/g] (Conditions 2-1 and 2-2). There are conditions in which the determination of developing device is "OK" and the determination result is "BAD" (Conditions 1-3 to 1-6).

In comparison between the determination result based on the abnormality level X2 and the determination of developing device, when the toner developing resistance TR is 15 [MΩ], there is a condition in which the determination of developing device is "OK" and the determination result is "BAD" (Condition 1-3).

On the other hand, as illustrated in FIG. 8, in comparison between the determination result based on the abnormality level X and the determination of developing device, the determination result "BAD" depends on the toner charge amount TQ and the toner developing resistance TR (above the abnormality level X). By defining the function FT indicating a correspondence between the toner charge amount TQ and the toner developing resistance TR in this way, it is possible to more accurately determine a replacement timing of the developing device 64. That is, the determination result based on the abnormality level X in this embodiment can allow the replacement timing of the developing device 64 to be more accurately determined than the determination of developing device.

An embodiment of the present disclosure has been described above with reference to the drawings (FIGS. 1 to 8). The disclosure is not limited to the embodiment and can be modified in various forms without departing from the gist of the disclosure. For the purpose of easy understanding, the drawings are schematically illustrated with the elements as main entities, and thicknesses, lengths, numbers, and the like of the elements in the drawings are different from actual ones in view of description of the drawings. Materials, shapes, sizes, and the like of the elements in the embodiment are examples and are not particularly limited and can be modified in various values without substantially departing from the advantages of the disclosure.

INDUSTRIAL APPLICABILITY

The technique described in the present disclosure can be used for the field of image forming apparatuses.

While the present disclosure has been described in detail with reference to the embodiments thereof, it would be apparent to those skilled in the art that various changes and modifications may be made therein within the scope defined by the appended claims.

What is claimed is:

1. An image forming apparatus comprising:

an image carrier on a surface of which an electrostatic latent image is formed;

a developing device that supplies a toner to the image carrier and develops the electrostatic latent image formed on the image carrier to form a toner image;

a density detecting device that detects a density of the toner image developed by the developing device;

a current measuring device that measures a developing current flowing in the developing device; and a control device including a processor, and configured to act, when the processor executes a control program, as:

a toner charge amount predictor configured to predict a toner charge amount which is an amount of electric charge of the toner supplied to the image carrier by the developing device;

a toner developing resistance calculator configured to calculate a toner developing resistance on the basis of a bias voltage applied to the developing device and the developing current measured by the current measuring device when the electrostatic latent image is developed by the developing device; and a determiner configured to determine a state of the developing device on the basis of the toner charge amount predicted by the toner charge amount predictor and the toner developing resistance calculated by the toner developing resistance calculator, wherein the toner charge amount predictor predicts the toner charge amount on the basis of the density detected by the density detecting device and the developing current, wherein the toner developing resistance calculator calculates the toner developing resistance by dividing a value of the bias voltage by a value of the developing current, wherein the toner developing resistance calculator calculates a plurality of toner developing resistances on the basis of each of the developing currents corresponding to a plurality of bias voltages and calculates one toner developing resistance which is used for the determiner to determine a state of the developing device, on the basis of each of the calculated toner developing resistances, and wherein the toner developing resistance calculator calculates a linear function indicating a correspondence between the calculated toner developing resistances and determines a slope of the calculated linear function as the toner developing resistance which is used for the determiner to determine the state of the developing device.

2. An image forming apparatus comprising:

an image carrier on a surface of which an electrostatic latent image is formed;

a developing device that supplies a toner to the image carrier and develops the electrostatic latent image formed on the image carrier to form a toner image;

a density detecting device that detects a density of the toner image developed by the developing device;

a current measuring device that measures a developing current flowing in the developing device; and a control device including a processor, and configured to act, when the processor executes a control program, as:

a toner charge amount predictor configured to predict a toner charge amount which is an amount of electric charge of the toner supplied to the image carrier by the developing device;

a toner developing resistance calculator configured to calculate a toner developing resistance on the basis of a bias voltage applied to the developing device and the developing current measured by the current measuring device when the electrostatic latent image is developed by the developing device; and a determiner configured to determine a state of the developing device on the basis of the toner charge amount predicted by the toner charge amount predictor and the toner developing resistance calculated by the toner developing resistance calculator, wherein the toner charge amount predictor predicts the toner charge amount on the basis of the density detected by the density detecting device and the developing current, wherein the toner developing resistance calculator calculates the toner developing resistance by dividing a value of the bias voltage by a value of the developing current, wherein the determiner calculates an abnormality level indicating a degree of abnormality of the developing device on the basis of a function indicating a correspondence between the toner charge amount and the toner developing resistance, and wherein the determiner determines a state of the developing device on the basis of the calculated abnormality level.

3. An image forming apparatus comprising:

an image carrier on a surface of which an electrostatic latent image is formed;

a developing device that supplies a toner to the image carrier and develops the electrostatic latent image formed on the image carrier to form a toner image;

a density detecting device that detects a density of the toner image developed by the developing device;

a current measuring device that measures a developing current flowing in the developing device; and a control device including a processor, and configured to act, when the processor executes a control program, as:

a toner charge amount predictor configured to predict a toner charge amount which is an amount of electric charge of the toner supplied to the image carrier by the developing device;

a toner developing resistance calculator configured to calculate a toner developing resistance on the basis of a bias voltage applied to the developing device and the developing current measured by the current measuring device when the electrostatic latent image is developed by the developing device; and a determiner configured to determine a state of the developing device on the basis of the toner charge amount predicted by the toner charge amount predictor and the toner developing resistance calculated by the toner developing resistance calculator, wherein the toner charge amount predictor predicts the toner charge amount on the basis of the density detected by the density detecting device and the developing current, and wherein the toner developing resistance calculator calculates the toner developing resistance by dividing a value of the bias voltage by a value of the developing current, the image forming apparatus further comprising a storage device that stores an abnormality table indicating a correspondence between a combination of the toner charge amount and the toner developing resistance and the abnormality level, wherein the determiner determines a state of the developing device on the basis of the abnormality table.

* * * * *